US010309714B2

(12) United States Patent
Jin et al.

(10) Patent No.: US 10,309,714 B2
(45) Date of Patent: Jun. 4, 2019

(54) SIDE-BY-SIDE REFRIGERATOR

(71) Applicants: HEFEI HUALING CO., LTD., Hefei (CN); MIDEA GROUP CO., LTD., Foshan (CN)

(72) Inventors: Xianghua Jin, Hefei (CN); Xuezai Zheng, Hefei (CN)

(73) Assignees: HEFEI HUALING CO., LTD., Hefei (CN); MIDEA GROUP CO., LTD., Foshan (CN)

( * ) Notice: Subject to any disclaimer, the term of this patent is extended or adjusted under 35 U.S.C. 154(b) by 0 days.

(21) Appl. No.: 15/760,633

(22) PCT Filed: Apr. 22, 2016

(86) PCT No.: PCT/CN2016/079978

§ 371 (c)(1),
(2) Date: Mar. 16, 2018

(87) PCT Pub. No.: WO2017/107351

PCT Pub. Date: Jun. 29, 2017

(65) Prior Publication Data

US 2018/0299186 A1 Oct. 18, 2018

(30) Foreign Application Priority Data

Dec. 22, 2015 (CN) ..... 2015 1 0981560
Dec. 22, 2015 (CN) ..... 2015 2 1088333 U

(51) Int. Cl.
*E05C 1/00* (2006.01)
*E05C 1/08* (2006.01)
(Continued)

(52) U.S. Cl.
CPC ..... *F25D 23/028* (2013.01); *E05B 65/0042* (2013.01); *E05C 1/006* (2013.01);
(Continued)

(58) Field of Classification Search
CPC ..... F25D 23/028; F25D 2323/021; E05B 65/0042; E05C 1/006; E05C 1/085; E05C 7/04
See application file for complete search history.

(56) References Cited

U.S. PATENT DOCUMENTS 1,918,911 A 7/1933 Hull
2,692,809 A 10/1954 Kesling
(Continued)

FOREIGN PATENT DOCUMENTS

CN 201858833 U 6/2011
CN 202074770 U 12/2011
(Continued)

OTHER PUBLICATIONS

International Search Report dated Oct. 10, 2016 in the corresponding CN application(application No. PCT/CN2016/079978).
(Continued)

*Primary Examiner* — Daniel J Rohrhoff
(74) *Attorney, Agent, or Firm* — Kilpatrick Townsend & Stockton, LLP

(57) ABSTRACT

Disclosed is a side-by-side refrigerator. The side-by-side refrigerator include a refrigerator body, the interior of the refrigerator body being provided with a refrigerating compartment; a first door body and a second door body, and the first door body and the second door body are respectively arranged on the refrigerator body to jointly open and close the refrigerating compartment, the first door body is provided with a first door seal, and the second door body is provided with a second door seal, and a door body locking assembly, and the first door body and the second door body are locked by the door body locking assembly when the refrigerating compartment is closed, and the first door seal
(Continued)

and the second door seal jointly seal a gap between the first door body and the second door body.

7 Claims, 3 Drawing Sheets

(51) Int. Cl.

| | |
|---|---|
| ***E05C 7/04*** | (2006.01) |
| ***E05B 65/00*** | (2006.01) |
| ***E05C 19/02*** | (2006.01) |
| ***F25D 23/02*** | (2006.01) |

(52) U.S. Cl.
CPC ..... *E05C 1/085* (2013.01); *E05C 7/04* (2013.01); *E05C 19/02* (2013.01); *F25D 23/02* (2013.01); *F25D 2323/021* (2013.01)

(56) References Cited

U.S. PATENT DOCUMENTS

| | | | | |
|---|---|---|---|---|
| 2,767,040 | A | 10/1956 | Kesling | |
| 3,583,737 | A | 6/1971 | Zenzi | |
| 5,425,205 | A * | 6/1995 | Ha | E05B 65/0042 49/366 |
| 7,543,897 | B2 * | 6/2009 | Kim | E05B 65/0042 312/296 |
| 2006/0232176 | A1 * | 10/2006 | Kim | E05D 3/12 312/405 |
| 2014/0327354 | A1 * | 11/2014 | Chen | F25D 23/02 312/405 |

FOREIGN PATENT DOCUMENTS

| | | | |
|---|---|---|---|
| CN | 102518348 | A | 6/2012 |
| CN | 105423686 | A | 3/2016 |
| CN | 205332647 | U | 6/2016 |
| JP | 2002206854 | A | 8/2002 |
| WO | 02061989 | A1 | 10/2002 |
| WO | 2006090958 | A1 | 8/2006 |

OTHER PUBLICATIONS

CN Office Action dated Jan. 25, 2018 in the corresponding CN application(application No. 201510981560.4).
CN Office Action dated May 27, 2017 in the corresponding CN application(application No. 201510981560.4).
European Search Report dated Nov. 15, 2018 in the corresponding EP application (application No. 16877165.7).

* cited by examiner

SIDE-BY-SIDE REFRIGERATOR

CROSS-REFERENCE TO RELATED APPLICATION

This application is a national phase entry under 35 USC § 371 of International Application PCT/CN2016/079978, filed Apr. 22, 2016, which claims priority to and benefits of Chinese Patent Application Serial No. 201510981560.4 and 201521088333.0, filed with the State Intellectual Property Office of P. R. China on Dec. 22, 2015, the entire contents of which are incorporated herein by reference.

FIELD

The present disclosure relates to a technical field of electric appliance manufacture, and specifically to a side-by-side refrigerator.

BACKGROUND

In a side-by-side refrigerator in the related art, in order to seal a gap between two door bodies, it is required to mount a turnover beam to one door body, but the turnover beam has a complicated structure and larger number of components and parts, which not only increases the part cost of the refrigerator, but also influences the assembly efficiency of the refrigerator.

SUMMARY

The present disclosure seeks to solve one of the technical problems existing in the related art to at least some extent. Thus, the present disclosure provides a side-by-side refrigerator which has advantages of a simple structure, low cost, high production efficiency and etc.

In order to achieve the above objective, embodiments of the present disclosure provide a side-by-side refrigerator, the side-by-side refrigerator includes: a refrigerator body having a refrigerating compartment therein; a first door body and a second door body pivotably arranged on the refrigerator body respectively so as to jointly open and close the refrigerating compartment, the first door body being provided with a first door seal and the second door body being provided with a second door seal; and a door body locking assembly, in which when the first door body and the second door body close the refrigerating compartment, the first door body and the second door body are locked by the door body locking assembly and the first door seal and the second door seal jointly seal a gap between the first door body and the second door body.

The side-by-side refrigerator according to embodiments of the present disclosure has the advantages of a simple structure, low cost, high production efficiency and etc.

In addition, the side-by-side refrigerator according to embodiments of the present disclosure further has the following additional technical features:

According to an embodiment of the present disclosure, the first door body is provided with a first hanger and the second door body is provided with a second hanger, and the first hanger and the second hanger are locked by the door body locking assembly when the first door body and the second door body close the refrigerating compartment.

According to an embodiment of the present disclosure, the door body locking assembly includes: a casing provided to the refrigerator body; a first claw and a second claw, the first claw and the second claw being rotatably disposed to the casing separately; a first elastic piece and a second elastic piece, the first elastic piece being compressed between the casing and the first claw and the second elastic piece being compressed between the casing and the second claw, in which when the first door body and the second door body close the refrigerating compartment, the first hanger is hooked by the first claw under an action of the first elastic piece and the second hanger is hooked by the second claw under an action of the second elastic piece.

According to an embodiment of the present disclosure, the first hanger is provided with a first locking lug having a circular cross section, the first claw is provided with a first guiding slope and a first locking arc surface located behind the first guiding slope, the second hanger is provided with a second locking lug having a circular cross section, the second claw is provided with a second guiding slope and a second locking arc surface located behind the second guiding slope, when the first door body and the second door body close the refrigerating compartment, the first claw is hooked to the first locking arc surface under a guidance of the first guiding slope and the second claw is hooked to the second locking arc surface under a guidance of the second guiding slope.

According to an embodiment of the present disclosure, the first claw and the second claw are arranged opposite to each other in first and second directions, and a rotation axis of the first claw and a rotation axis of the second claw are parallel and oriented in up and down directions.

According to an embodiment of the present disclosure, the casing is located at a center of the refrigerator body in first and second directions, the first hanger is disposed to a rear surface of the first door body and adjacent to a second side face of the first door body, and the second hanger is disposed to a rear surface of the second door body and adjacent to a first side surface of the second door body.

According to an embodiment of the present disclosure, the casing includes a body having an accommodating cavity, the accommodating cavity having an open rear surface, a front surface of the body being provided with a locking opening communicated with the accommodating cavity, the first claw, the second claw, the first elastic piece and the second elastic piece being all arranged in the accommodating cavity, and the first claw extending into the locking opening under an action of the first elastic piece and the second claw extending into the locking opening under an action of the second elastic piece; and a cover detachably mounted to the body and covering the rear surface of the accommodating cavity.

According to an embodiment of the present disclosure, the first claw is provided with a first rotation shaft, the second claw is provided with a second rotation shaft, the cover and the body jointly define a first rotation shaft groove and a second rotation shaft groove, the first rotation shaft is rotatably fitted in the first rotation shaft groove, and the second rotation shaft is rotatably fitted in the second rotation shaft groove.

According to an embodiment of the present disclosure, the first elastic piece and the second elastic piece are both springs, a first side surface of the first claw is provided with a first positioning column and a second side surface of the second claw is provided with a second positioning column, the first elastic piece has a first first end abutted against a first side wall of the accommodating cavity and a first second end fitted over the first positioning column, the second elastic piece has a second first end fitted over the second positioning column and a second second end abutted against a second side wall of the accommodating cavity.

According to an embodiment of the present disclosure, two door body locking assemblies are provided and disposed to an upper face and a lower face of the refrigerating compartment respectively.

Figure 1:
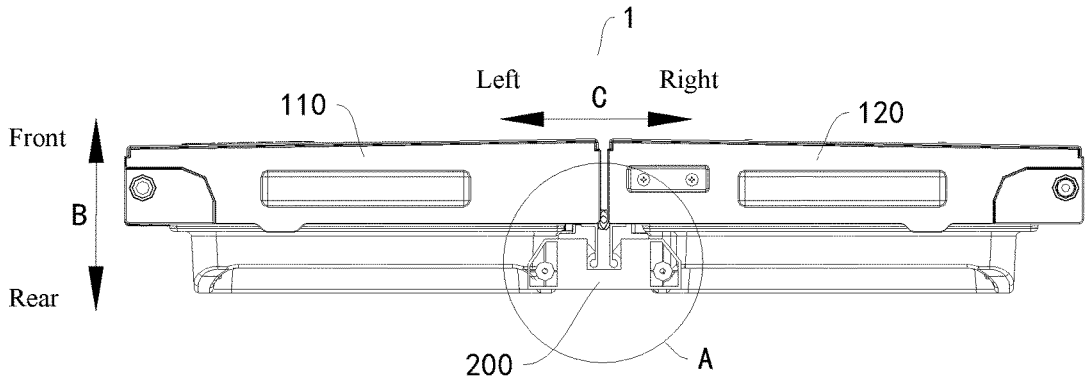
FIG. 1 is a partial schematic view of a side-by-side refrigerator according to embodiments of the present disclosure.

Reference numerals: side-by-side refrigerator 1, first door body 110, first door seal 111, first hanger 112, first locking lug 1120, second door body 120, second door seal 121, second hanger 122, second locking lug 1220, door body locking assembly 200, casing 210, body 211, locking opening 2110, first rotation shaft groove 2111, second rotation shaft groove 2112, cover 212, first limiting rib 2121, second limiting rib 2122, first limiting plate 2123, second limiting plate 2124, first claw 220, first guiding slope 221, first locking arc surface 222, first rotation shaft 223, first positioning column 224, second claw 230, second guiding slope 231, second locking arc surface 232, second rotation shaft 233, second positioning column 234, first elastic piece 241, second elastic piece 242.

DETAILED DESCRIPTION

Embodiments of the present disclosure will be described in detail and examples of the embodiments will be illustrated in the drawings, where same or similar reference numerals are used to indicate same or similar members or members with same or similar functions. The embodiments described herein with reference to drawings are explanatory, which are used to illustrate the present disclosure, but shall not be construed to limit the present disclosure.

A side-by-side refrigerator 1 according to embodiments of the present disclosure is described in the following with reference to the accompany drawings.

As illustrated in FIG. 1 to FIG. 4, the side-by-side refrigerator 1 according to embodiments of the present disclosure includes a refrigerator body (not illustrated in the figures), a first door body 110, a second door body 120 and a door body locking assembly 200 (first and second directions are shown by an arrow C in FIG. 1 to FIG. 4).

The refrigerator body is provided with a refrigerating compartment therein. The first door body 110 and the second door body 120 are pivotably arranged on the refrigerator body respectively so as to jointly open and close the refrigerating compartment, and the first door body 110 and the second door body 120 are arranged to be opened oppositely. The first door body 110 is provided with a first door seal 111 and the second door body 120 is provided with a second door seal 121. When the first door body 110 and the second door body 120 close the refrigerating compartment, the first door body 110 and the second door body 120 are locked by the door body locking assembly 200 and the first door seal 111 and the second door seal 121 jointly seal a gap between the first door body 110 and the second door body 120.

In the side-by-side refrigerator 1 according to embodiments of the present disclosure, by providing the door body locking assembly 200, the first door body 110 and the second door body 120 can be locked by mean of the door body locking assembly 200, so as to lock the first door body 110 and the second door body 120 when the first door body 110 and the second door body 120 jointly close the refrigerating compartment, thus preventing the first door body 110 and the second door body 120 from being opened in cases except that the users open the first door body 110 and the second door body 120 on their own initiative, and guaranteeing reliability of the first door body 110 and the second door body 120 for closing the refrigerating compartment.

In addition, by arranging the first door seal 111 to the first door body 110 and arranging the second door seal 121 to the second door body 120, it is possible to jointly seal the gap between the first door body 110 and the second door body 120 by means of the first door seal 111 and the second door seal 121 when the first door body 110 and the second door body 120 close the refrigerating compartment. Furthermore, as the first door body 110 and the second door body 120 are locked by the door body locking assembly 200 when the first door body 110 and the second door body 120 close the refrigerating compartment, it is possible to further guarantee sealing effect on the gap between the first door body 110 and the second door body 120 by means of the first door seal 111 and the second door seal 121, thus guaranteeing the leak-proofness of the refrigerating compartment.

In addition, as the gap between the first door body 110 and the second door body 120 of the side-by-side refrigerator 1 is sealed by the first door seal 111 and the second door seal 121 and the first door body 110 and the second door body 120 are locked by means of the door body locking assembly 200, compared with the manner in related art that the gap between door bodies is sealed by means of a turnover beam, it is possible to not only omit the part cost of the turnover beam, further simplify the structure of the side-by-side refrigerator 1, reduce the number of the parts of the side-by-side refrigerator 1 and hence the manufacture cost of the side-by-side refrigerator 1, but also omit assembly procedure for mounting the turnover beam, simplify the assembly process of the side-by-side refrigerator 1, improve the production efficiency of the side-by-side refrigerator 1, reduce the operation intensity of installation personnel so as to reduce labor cost, thus further reduce the production cost of the side-by-side refrigerator 1.

Thus, the side-by-side refrigerator 1 according to embodiments of the present disclosure has advantages of a simple structure, low cost, high production efficiency and etc.

The side-by-side refrigerator 1 according to embodiments of the present disclosure is described in the following with reference to accompany drawings.

In some embodiments of the present disclosure, as illustrated in FIG. 1 to FIG. 4, the side-by-side refrigerator 1 according to embodiments of the present disclosure includes the refrigerator body, the first door body 110, the second door body 120 and the door body locking assembly 200. The first door seal 111 is located at a second side wall of the first door body 110 and disposed adjacent to a rear surface of the first door body 110, and the second door seal 121 is located at a first side wall of the second door body 120 and disposed adjacent to a rear surface of the second door body 120.

The first door body 110 is provided with a first hanger 112 and the second door body 120 is provided with a second hanger 122, and the first hanger 112 and the second hanger 122 are locked by the door body locking assembly 200 when the first door body 110 and the second door body 120 close the refrigerating compartment. Thus, the first hanger 112 and the second hanger 122 can be conveniently used to position the first door body 110 and the second door body 120, such that the door body locking assembly 200 can conveniently lock the first door body 110 and the second door body 120.

Figure 2:
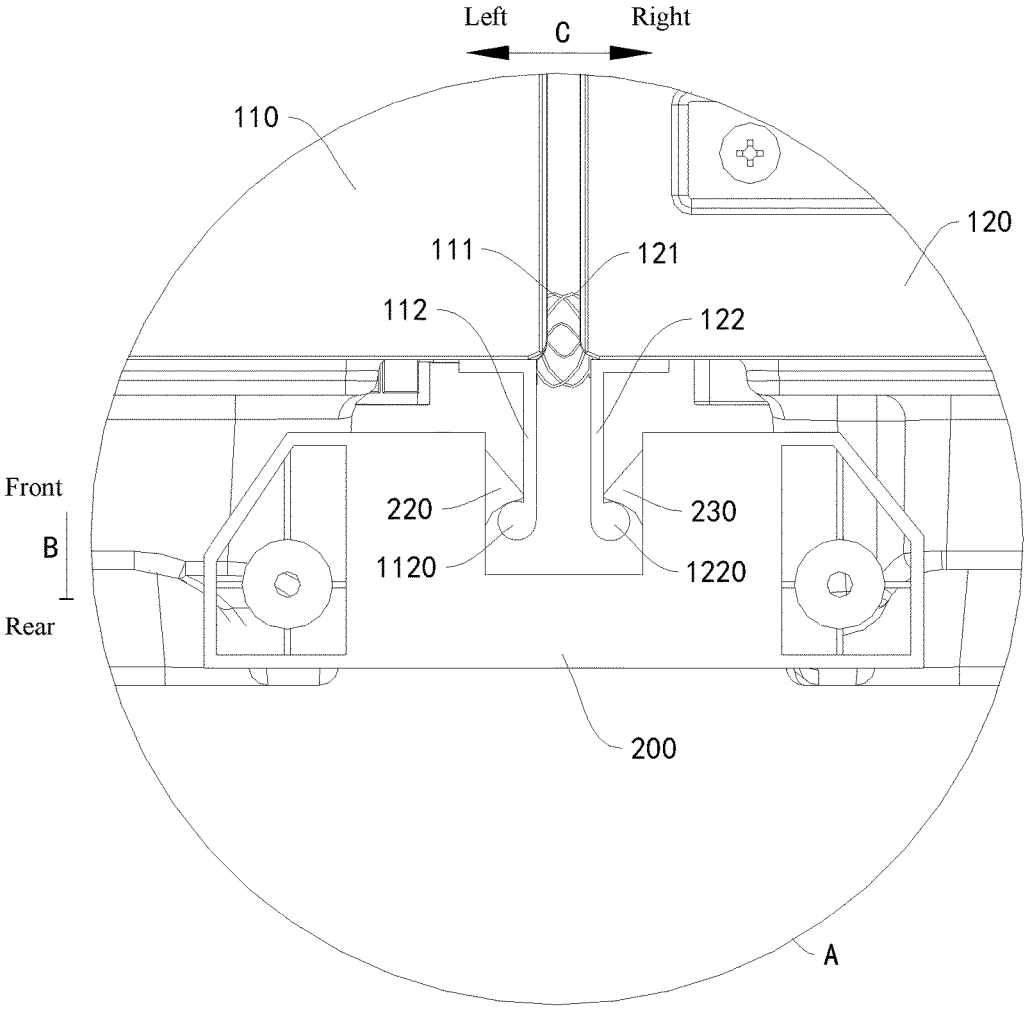
FIG. 2 is an enlarged view of portion A circled in FIG. 1.
Figure 3:
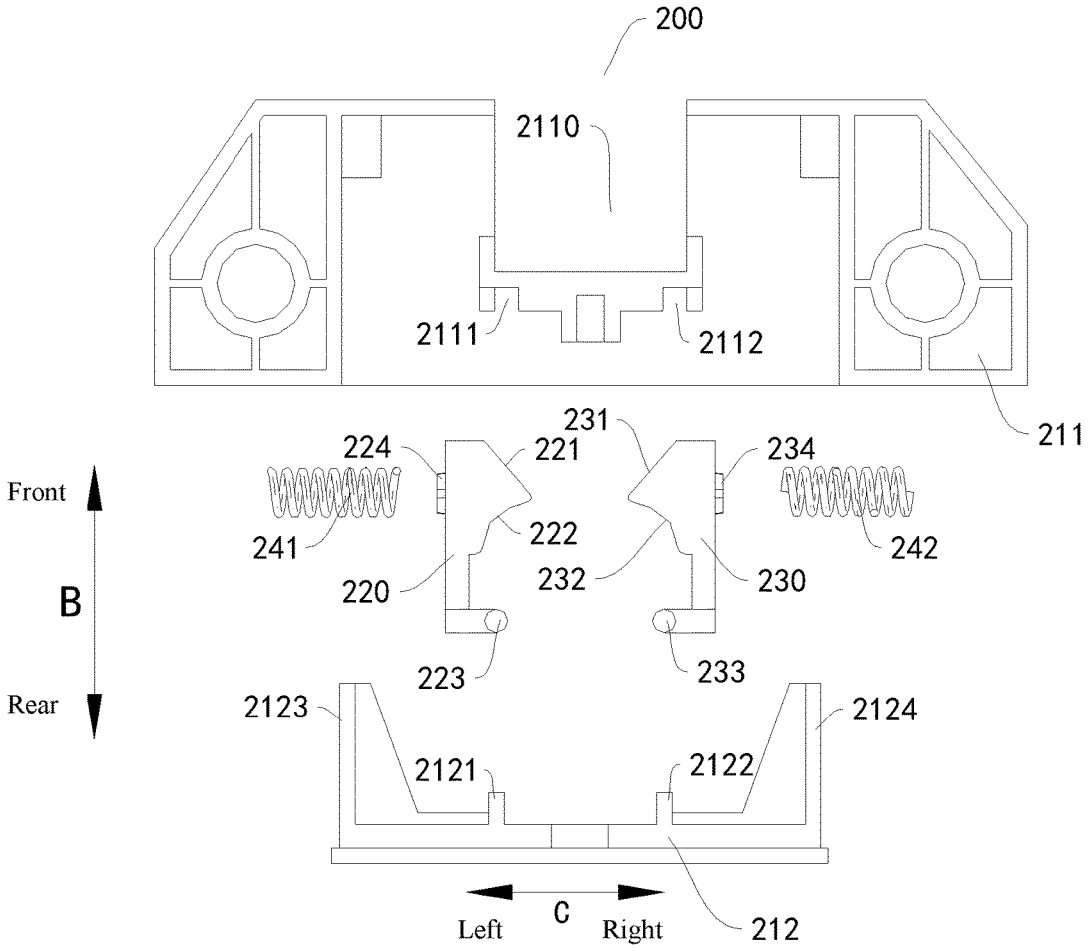
FIG. 3 is an exploded view of a door body locking assembly of a side-by-side refrigerator according to embodiments of the present disclosure.
Figure 4:
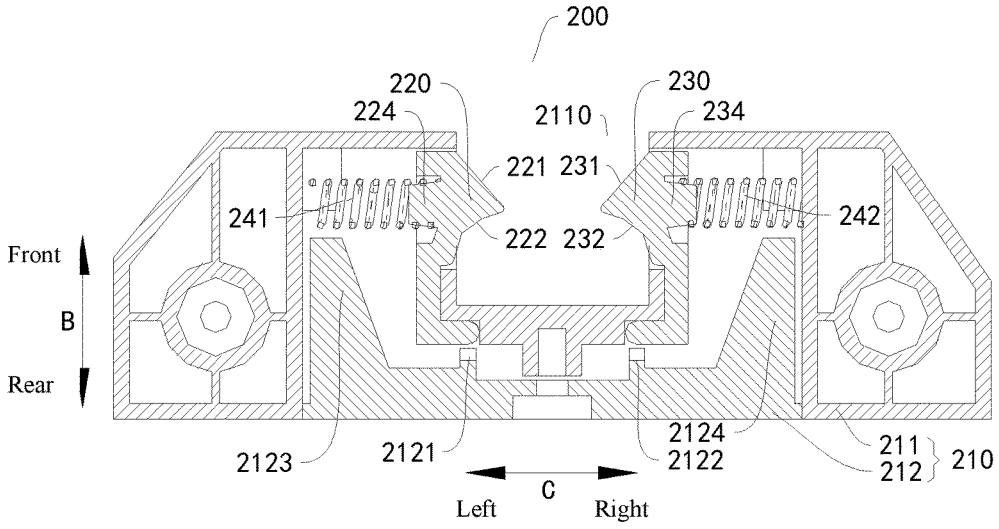
FIG. 4 is a sectional view of a door body locking assembly of a side-by-side refrigerator according to embodiments of the present disclosure.

Specifically, as illustrated in FIG. 2 to FIG. 4, the door body locking assembly 200 includes a casing 210, a first claw 220, a second claw 230, a first elastic piece 241 and a second elastic piece 242. The casing 210 is provided to the refrigerator body. The first claw 220 and the second claw 230 are rotatably disposed to the casing 210 separately. The first elastic piece 241 is compressed between the casing 210 and the first claw 220 and the second elastic piece 242 is compressed between the casing 210 and the second claw 230. When the first door body 110 and the second door body 120 close the refrigerating compartment, the first hanger 112 is hooked by the first claw 220 under the action of the first elastic piece 241 and the second hanger 122 is hooked by the second claw 230 under the action of the second elastic piece 242. Thus, in the processes of opening and closing the door body, the first claw 220 and the second claw 230 can be squeezed by the first hanger 112 and the second hanger 122, enabling the first claw 220 and the second claw 230 to overcome an elastic force of the elastic piece to rotate, thereby facilitating the opening and locking of the door body. Therefore, it is possible to lock the first door body 110 by means of the first hanger 112 and the first claw 220 and lock the second door body 120 by means of the second hanger 122 and the second claw 230, which not only releases the user from considering the sequence of door opening, thus improving the convenience of the side-by-side refrigerator 1, but also facilitates the assembly of the door body locking assembly 200 by providing the casing 210. For example, the first claw 220, the second claw 230, the first elastic piece 241 and the second elastic piece 242 can be firstly mounted to the casing 210 to form the door body locking assembly 200, and the door body locking assembly 200 can be then mounted to the refrigerator body.

More specifically, as illustrated in FIG. 2 to FIG. 4, the first hanger 112 is provided with a first locking lug 1120 having a circular cross section, the first claw 220 is provided with a first guiding slope 221 and a first locking arc surface 222 located behind the first guiding slope 221, the second hanger 122 is provided with a second locking lug 1220 having a circular cross section, the second claw 230 is provided with a second guiding slope 231 and a second locking arc surface 232 located behind the second guiding slope 231. When the first door body 110 and the second door body 120 close the refrigerating compartment, the first claw 220 is hooked to the first locking arc surface 222 under a guidance of the first guiding slope 221 and the second claw 230 is hooked to the second locking arc surface 232 under a guidance of the second guiding slope 231. Specifically, the first locking lug 1120 can be located at a first side wall of the first hanger 112 and disposed adjacent to a rear end of the first hanger 112, and the second locking lug 1220 can be located at a second side wall of the second hanger 122 and disposed adjacent to a rear end of the second hanger 122 (front and rear directions are shown by an arrow B in FIG. 1 to FIG. 4). In this way, the processes of opening and closing the door body can be more smooth, so as to facilitate the opening and closing of the door body, and the opening of the door body by itself in conditions where the user doesn't apply a force to the door body can be prevented, so as to guarantee the reliability of the side-by-side refrigerator 1.

Optionally, as illustrated in FIG. 2 to FIG. 4, the first claw 220 and the second claw 230 are arranged opposite to each other in the first and second directions, and a rotation axis of the first claw 220 and a rotation axis of the second claw 230 are parallel and oriented along up and down directions. Thus, the first claw 220 and the second claw 230 can be enabled to rotate in a horizontal direction, so as to facilitate the opening and closing of the door body in the horizontal direction.

Advantageously, as illustrated in FIG. 2 to FIG. 4, the casing 210 is located at a center of the refrigerator body in the first and second directions, the first hanger 112 is disposed to the rear surface of the first door body 110 and adjacent to a second side surface of the first door body 110, the second hanger 122 is disposed to the rear surface of the second door body 120 and adjacent to a first side surface of the second door body 120. Thus, the door body locking assembly 200 can be applied to refrigerators having the first door body 110 and the second door body 120 of same size, and locking effect on the first door body 110 and the second door body 120 by means of the door body locking assembly 200 as well as sealing effect on the gap between the first door body 110 and the second door body 120 can be improved.

In one embodiment, the casing 210 can also be not disposed at the center of the refrigerator body in the horizontal direction, so as to enable the door body locking assembly 200 to be applied to refrigerators having door bodies of different sizes.

Specifically, the casing 210 can be mounted to the refrigerator body by means of threaded fasteners.

FIG. 3 and FIG. 4 illustrate the side-by-side refrigerator 1 according to a specific example of the present disclosure. As illustrated in FIG. 3 and FIG. 4, the casing 210 includes a body 211 and a cover 212. The body 211 has an accommodating cavity, the accommodating cavity has an open rear surface, a front surface of the body 211 is provided with a locking opening 2110 communicated with the accommodating cavity. The first claw 220, the second claw 230, the first elastic piece 241 and the second elastic piece 242 are all arranged in the accommodating cavity. The first claw 220 extends into the locking opening 2110 under the action of the first elastic piece 241 and the second claw 230 extends into the locking opening 2110 under the action of the second elastic piece 242. The cover 212 is detachably mounted to the body 211 and covers the rear surface of the accommodating cavity. Thus, it is convenient for the assembly and disassembly of the door body locking assembly 200, so as to facilitate the detachment and repair of the door body locking assembly 200.

Specifically, as illustrated in FIG. 3 and FIG. 4, the first claw 220 is provided with a first rotation shaft 223, the second claw 230 is provided with a second rotation shaft 233, the cover 212 and the body 211 jointly define a first rotation shaft groove 2111 and a second rotation shaft groove 2112, the first rotation shaft 223 is rotatably fitted in the first rotation shaft groove, and the second rotation shaft 233 is rotatably fitted in the second rotation shaft groove. Thus, it is possible to achieve that the first claw 220 and the second claw 230 can be rotatably disposed to the casing 210.

Specifically, as illustrated in FIG. 3 and FIG. 4, the cover 212 is provided with a first limiting rib 2121 and a second limiting rib 2122, the body 211 can be provided with a first notch and a second notch, the first notch and the first limiting rib 2121 jointly define the first rotation shaft groove 2111 and the second notch and the second limiting rib 2122 jointly define the second rotation shaft groove 2112. In this way, during the assembly, the rotation shaft can be firstly fitted in the notch, and then be positioned by using the limiting rib, to prevent the rotation shaft from breaking away from the notch.

Optionally, as illustrated in FIG. 3 and FIG. 4, the first elastic piece 241 and the second elastic piece 242 are both springs, a first side surface of the first claw 220 is provided with a first positioning column 224 and a second side surface of the second claw 230 is provided with a second positioning column 234. The first elastic piece 241 has a first first end abutted against a first side wall of the accommodating cavity and a first second end fitted over the first positioning column 224, the second elastic piece 242 has a second first end fitted over the second positioning column 234 and a second second end abutted against a second side wall of the accommodating cavity. Thus, the ends of the springs adjacent to the claws can be positioned by means of the first positioning column 224 and the second positioning column 234, so as to improve the stability of the springs.

Specifically, as illustrated in FIG. 3 and FIG. 4, the casing 210 can be provided with a first limiting plate 2123 and a second limiting plate 2124. The first end of the first elastic piece 241 can be abutted between a front end of the first limiting plate 2123 and an inner wall of the body 211, the second end of the second elastic piece 242 can be abutted between a front end of the second limiting plate 2124 and an inner wall of the body 211, thus the first end of the first elastic piece 241 and the second end of the second elastic piece 242 can be further positioned so as to improve the stability of the springs further.

Advantageously, two door body locking assemblies are provided and disposed to an upper surface and a lower surface of the refrigerating compartment respectively. Thus, it is possible to not only lock an upper portion and a lower portion of the door body by means of the two door body locking assemblies 200 respectively, but also avoid a middle space of the refrigerating compartment, prevent the door body locking assembly 200 from influencing the user to take out or put in articles, thus further improving the using convenience for the user.

Other configurations and operations of the side-by-side refrigerator 1 according to embodiments of the present disclosure, which will not be described in detail here.

In the specification, it is to be understood that terms such as "central," "longitudinal," "lateral," "length," "width," "thickness," "upper," "lower," "front," "rear," "first," "second," "vertical," "horizontal," "top," "bottom," "inner," "outer," "axial," "radial," "circumferential direction," "clockwise," and "counterclockwise" should be construed to refer to the orientation as then described or as shown in the drawings under discussion. These relative terms are for convenience of description and do not require that the present specification be constructed or operated in a particular orientation, thus cannot be construed to limit the present disclosure.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description in the present specification, "a plurality of" means two or more than two, unless specified otherwise.

In the present specification, unless specified or limited otherwise, the terms "mounted," "connected," "coupled," "fixed" and the like are used broadly, and may be, for example, fixed connections, detachable connections, or integral connections; may also be mechanical connection, electrical connections, or be communicable to each other; may also be direct connections or indirect connections via intervening structures; may also be inner communications or interaction relationship of two elements.

In the present specification, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is second or obliquely "on," "above," or "on top of" the second feature, or just means that the first feature is at a height higher than that of the second feature; while a first feature "below," "under," or "on bottom of" a second feature may include an embodiment in which the first feature is second or obliquely "below," "under," or "on bottom of" the second feature, or just means that the first feature is at a height lower than that of the second feature.

Reference throughout this specification to "an embodiment," "some embodiments," "an example," "specific examples" or "some examples" means that a particular feature, structure, material, or characteristic described in connection with the embodiment or example is included in at least one embodiment or example of the present disclosure. Thus, the appearances of the above phrases throughout this specification are not necessarily referring to the same embodiment or example of the present disclosure. Furthermore, the particular features, structures, materials, or characteristics may be combined in any suitable manner in one or more embodiments or examples.

What is claimed is:

1. A refrigerator, comprising:

a refrigerator body having a refrigerating compartment therein;

a first door body and a second door body pivotably arranged on the refrigerator body respectively configured to jointly open and close the refrigerating compartment, the first door body having a first door seal and the second door body having a second door seal; and a door body locking assembly, wherein when the first door body and the second door body close the refrigerating compartment, the first door body and the second door body are locked by the door body locking assembly and the first door seal and the second door seal jointly seal a gap between the first door body and the second door body;

wherein the first door body having a first hanger and the second door body having a second hanger, and the first hanger and the second hanger are locked by the door body locking assembly when the first door body and the second door body close the refrigerating compartment;

wherein the door body locking assembly comprises:

a casing provided to the refrigerator body;

a first claw and a second claw, the first claw and the second claw being rotatably disposed to the casing separately;

a first elastic piece and a second elastic piece, the first elastic piece being arranged between the casing and the first claw and the second elastic piece being arranged between the casing and the second claw, wherein when the first door body and the second door body close the refrigerating compartment, the first hanger is hooked by the first claw under an action of the first elastic piece and the second hanger is hooked by the second claw under an action of the second elastic piece.

2. The refrigerator according to claim 1, wherein the first hanger having a first locking lug having a circular cross section, the first claw having a first guiding slope and a first locking arc surface located behind the first guiding slope, the second hanger having a second locking lug having a circular cross section, the second claw having a second guiding slope and a second locking arc surface located behind the second guiding slope, when the first door body and the second door body close the refrigerating compartment, the first claw is hooked to the first locking arc surface under a guidance of the first guiding slope and the second claw is hooked to the second locking arc surface under a guidance of the second guiding slope.

3. The refrigerator according to claim 1, wherein the first claw and the second claw are arranged opposite to each other in first and second directions, and a rotation axis of the first claw and a rotation axis of the second claw are parallel and oriented in up and down directions.

4. The refrigerator according to claim 1, wherein the casing is located at a center of the refrigerator body in first and second directions, the first hanger is disposed to a rear surface of the first door body and adjacent to a second side face of the first door body, and the second hanger is disposed to a rear surface of the second door body and adjacent to a first side surface of the second door body.

5. The refrigerator according to claim 1, wherein the casing comprises:

a body having an accommodating cavity, the accommodating cavity having an open rear surface, a front surface of the body being provided with a locking opening communicated with the accommodating cavity, the first claw, the second claw, the first elastic piece and the second elastic piece being all arranged in the accommodating cavity, and the first claw extending into the locking opening under an action of the first elastic piece and the second claw extending into the locking opening under an action of the second elastic piece; and a cover detachably mounted to the body and covering the rear surface of the accommodating cavity.

6. The refrigerator according to claim 5, wherein the first claw having a first rotation shaft, the second claw having a second rotation shaft, the cover and the body jointly define a first rotation shaft groove and a second rotation shaft groove, the first rotation shaft is rotatably fitted in the first rotation shaft groove, and the second rotation shaft is rotatably fitted in the second rotation shaft groove.

7. The refrigerator according to claim 5, wherein the first elastic piece and the second elastic piece are both springs, a first side surface of the first claw having a first positioning column and a second side surface of the second claw having a second positioning column, the first elastic piece has a first end abutted against a first side wall of the accommodating cavity and a second end fitted over the first positioning column, the second elastic piece has a second first end fitted over the second positioning column and a third end abutted against a second side wall of the accommodating cavity.

* * * * *